US008906339B2

(12) United States Patent
Wang et al.

(10) Patent No.: US 8,906,339 B2
(45) Date of Patent: Dec. 9, 2014

(54) HIGH MODULUS GRAPHITIZED CARBON FIBER AND METHOD FOR FABRICATING THE SAME

(75) Inventors: Chih-Yung Wang, Tainan (TW); I-Wen Liu, Kaohsiung (TW); Jong-Pyng Chen, Hsinchu (TW); Shu-Hui Cheng, Hsinchu County (TW); Syh-Yuh Cheng, Hsinchu County (TW)

(73) Assignee: Industrial Technology Research Institute, Hsinchu County (TW)

( * ) Notice: Subject to any disclaimer, the term of this patent is extended or adjusted under 35 U.S.C. 154(b) by 915 days.

(21) Appl. No.: 12/790,820

(22) Filed: May 29, 2010

(65) Prior Publication Data

US 2011/0158895 A1 Jun. 30, 2011

(30) Foreign Application Priority Data

Dec. 30, 2009 (TW) ..... 098145757 A

(51) Int. Cl.

| | |
|---|---|
| ***D01F 9/12*** | (2006.01) |
| ***D01F 9/14*** | (2006.01) |
| ***D01F 9/15*** | (2006.01) |
| ***D01F 9/22*** | (2006.01) |
| ***D01F 9/155*** | (2006.01) |
| ***D01F 9/145*** | (2006.01) |
| ***D01F 9/32*** | (2006.01) |

(52) U.S. Cl.

CPC .. *D01F 9/14* (2013.01); *D01F 9/15* (2013.01); *D01F 9/225* (2013.01); *D01F 9/155* (2013.01); *D01F 9/145* (2013.01); *D01F 9/22* (2013.01); *D01F 9/32* (2013.01)

USPC ..... 423/447.2; 423/447.1; 423/447.4; 423/447.6

(58) Field of Classification Search

None

See application file for complete search history.

(56) References Cited

U.S. PATENT DOCUMENTS

| | | | | |
|---|---|---|---|---|
| 4,197,282 | A | 4/1980 | Bailly-Lacresse et al. | |
| 6,372,192 | B1 | 4/2002 | Paulauskas et al. | |
| 7,824,495 | B1 * | 11/2010 | White et al. | 118/718 |
| 2010/0003515 | A1 * | 1/2010 | Tanaka et al. | 428/367 |

FOREIGN PATENT DOCUMENTS

| | | | |
|---|---|---|---|
| CN | 1696365 | A | 11/2005 |
| CN | 201063877 | Y | 5/2008 |
| CN | 101481837 | A | 7/2009 |
| JP | 2007-80742 | A | 3/2007 |

(Continued)

OTHER PUBLICATIONS

Zhang et al. Microstructure Transformation of Carbon Nanofibers During Graphitization; Trans Nonferrous Met. Soc. China; 18, pp. 1094-1099; 2008.*

Notification of examination opinion issued by the Taiwan Intellectual Property Office on Jul. 31, 2012, for the above-referenced application's counterpart application in Taiwan (Application No. 098145757 filed Dec. 30, 2009).

(Continued)

*Primary Examiner* — Guinever Gregorio

(74) *Attorney, Agent, or Firm* — Pai Patent & Trademark Law Firm; Chao-Chang David Pai

(57) ABSTRACT

The invention provides a high module carbon fiber and a fabrication method thereof. The high module carbon fiber includes the product fabricated by the following steps: subjecting a pre-oxidized carbon fiber to a microwave assisted graphitization process, wherein the pre-oxidized carbon fiber is heated to a graphitization temperature of 1000-3000° C. for 1-30 min. Further, the high module carbon fiber has a tensile strength of between 2.0-6.5 GPa and a module of between 200-650 GPa.

18 Claims, 6 Drawing Sheets

(56) References Cited

FOREIGN PATENT DOCUMENTS

| | | | |
|---|---|---|---|
| TW | 561207 | | 11/2003 |
| TW | I279471 | | 4/2007 |
| TW | 200745395 | A | 12/2007 |
| TW | 200902783 | | 1/2009 |

OTHER PUBLICATIONS

Notification of First Examination Opinion issued by China's State Intellectual Property Office on Nov. 28, 2013, for the above-referenced application's counterpart application in China (Application No. 201010593554.9).

* cited by examiner

HIGH MODULUS GRAPHITIZED CARBON FIBER AND METHOD FOR FABRICATING THE SAME

CROSS REFERENCE TO RELATED APPLICATIONS

This application is based upon and claims the benefit of priority from the prior Taiwan Patent Application No. 098145757, filed on Dec. 30, 2009, the entire contents of which are incorporated herein by reference.

BACKGROUND OF THE INVENTION

1. Field of the Invention

The present invention relates to a carbon fiber and method for fabricating the same, and in particular relates to a high module carbon fiber and method for fabricating the same.

2. Description of the Related Art

Carbon fibers have advantages of low specific gravity, good mechanical properties (tensile strength and module), high electric and thermal conductivity, and good knittability. Carbon fibers with high module and high strength are commonly used as reinforcement materials in advanced structural composites for building, navigation, aircraft or military applications. Raw materials of carbon fibers can be rayon, polyvinyl alcohol, polyvinylidene chloride, polyacrylonitrile (PAN), or pitch. Currently, carbon fibers are generally prepared from polyacrylonitrile (PAN) as raw material to fabricate carbon fibers with desired tensile strength. The graphite crystal characteristics of PAN carbon fibers are determined by XRD and Raman spectroscopy.

In XRD analysis of carbon fiber, the crystalline stacking size Lc of the graphite layer (indicating the <002> crystal orientation)) is determined by the half-width of the diffraction peak β, as described by the Equation (I):

$$Lc=K\lambda/\beta\cos\theta \qquad \text{Equation (I)}$$

K: constant; λ: wavelength of x-ray; θ: diffraction angle

The compactness of carbon fiber is proportional to the crystalline stacking size Lc thereof. Namely, the carbon fibers with higher crystalline stacking size Lc would exhibit improved tensile module.

In Raman analysis, a R is defined as a background-free Raman spectral intensity area ratio D/G of a G-peak appearing at wavelength of about 1580 $cm^{-1}$ and a D-peak appearing at wavelength of 1350 $cm^{-1}$, as described by Equation (II):

$$R=D/G \qquad \text{Equation (II)}$$

The G-peak results form the lattice vibrations of sp2 bonding in the graphite sheet and the d-peak results from the vibrations of carbon atoms located at the graphite sheet edge (defective graphite structure). The R value reduces in inverse ratio to the graphitization degree. Further, the R value has a relationship with the crystalline planar size La as shown in Equation (III)

$$La=44\times R^{-1} \qquad \text{Equation (III)}$$

In theory, the carbon fiber with higher crystalline planar size La exhibits improved graphitization degree, and increased grain size, but increased planar size along the fiber axis results in reducing tensile strength.

As shown in Table 1, the crystalline stacking size Lc and the crystalline planar size La of the carbon fibers (Toray-T300) are proportional to the graphitization temperature (from 2400° C. to 3000° C.). Further, the tensile modulus is proportional to the crystalline stacking size Lc, but the tensile strength is in inverse proportion to the larger crystalline planar size La.

TABLE 1

| Process temperature | Lc (Å) | La (nm) | tensile modulus/ GPa | tensile strength/ GPa |
|---|---|---|---|---|
| 2400 | 40.9 | 14.67 | 343 | 3.14 |
| 2500 | 44.8 | 15.20 | 356 | 2.85 |
| 2600 | 46.5 | 16.18 | 362 | 2.82 |
| 2700 | 53.2 | 17.36 | 381 | 2.66 |
| 2800 | 58.3 | 18.21 | 391 | 2.5 |
| 2900 | 62.9 | 19.11 | 418 | 2.24 |
| 3000 | 68.4 | 19.65 | 424 | 2.2 |

PAN carbon fibers generally have high tensile strength. However, due to the chaotic crystalline stacks, PAN carbon fibers exhibit inferior tensile module. In order to fabricate high tensile strength and high module PAN carbon fibers, a graphitization process with a higher process temperature and a longer graphitizing period is called for. Due to the low cost, the high tensile strength PAN carbon fiber has become mainstream in recent years, in comparison with commercial high tensile strength and high module carbon fiber.

On the other hand, due to the higher crystalline planar size La, the high tensile strength and high module carbon fiber (Toray MJ series) exhibits lower tensile strength than the high tensile strength carbon fibers (Toray T series). In conventional graphitization processes, the crystalline stacking size Lc and the crystalline planar size La are increased simultaneously. However, the carbon fiber has higher crystalline planar size La resulting in lower tensile strength.

It is important to reduce the fabrication cost of the high tensile strength and high module carbon fiber. In the convention graphitization process, the obtained carbon fiber has a tensile module proportional to the graphitization temperature, but has a tensile strength in inverse proportion to the graphitization temperature. It is necessary to improve the tensile modulus of the high tensile strength PAN carbon fibers without reducing the tensile thereof. Specifically, the crystalline stacking size of the high tensile strength carbon fiber should be increased based on the premise that the crystalline planar size La is not greatly changed, in order to fabricate high tensile strength and high module carbon fibers.

There are several graphitization processes for fabricating carbon fibers such as graphitization employing a conventional electric furnace, as disclosed in JP200780742, TW 561207, TW 200902783, and TW279471. Those patents disclosed the methods for fabricating carbon fibers via an electric furnace. However, due to the low thermal conductivity, incomplete thermal insulation and low heating rate, the total graphitization process by means of an electric furnace has a process period of 1-10 hr. Therefore, it is hard to limit the crystalline planar size La within a specific range. The aforementioned graphitization process is very time-consuming and power-consuming. Thus, its use is disadvantageous in view of the cost of carbon fibers.

Moreover, a graphitization process in company with microwave induction heating has been developed and includes the following steps. Fibers prepared from pitch, coal, or fibrin are subjected to a pre-graphitization process (t a temperature of more than 300° C., such as 300-1500° C.). Next, the-graphitization fibers are subjected to a graphitization process with microwave induction heating. The aforementioned process has a disadvantage of requiring a longer pre-graphitization period (of more than 4 hr). Further, since the raw materials used in the process (such as pitch, coal, or fibrin) have a low carbon content, it is hard to fabricate high strength and high module carbon fibers via this method.

U.S. Pat. No. 6,372,192 B1 discloses a graphitization process of polyacrylonitrile fiber (PAN) with microwave plasma, including subjecting a PAN fiber to a pre-oxidization at 500° C., and performing the graphitization process with microwave plasma to the pre-oxidized carbon fiber under vacuum. Since the microwave energy transmitted by gas ions only achieves the outward portion of the pre-oxidized carbon fiber and the generated heat is difficult to conduct into the inward portion of the pre-oxidized carbon fiber, the obtained fiber exhibits low tensile strength (2.3 GPa) and low tensile module (192 GPa).

Therefore, it is necessary to develop a novel polyacrylonitrile carbon fiber with higher crystalline stacking size Lc and lower crystalline planar size La compared to conventional carbon fibers. The module will be enhanced (more than 200 GPa) and will meet the increased tensile strength requirements.

BRIEF SUMMARY OF THE INVENTION

The invention provides a high module carbon fiber, including the product fabricated by the following steps: subjecting a pre-oxidized carbon fiber with a microwave assisted graphitization process, wherein the pre-oxidized carbon fiber is heated to a graphitization temperature of 1000-3000° C. for 1-30 min. Specifically, the pre-oxidized carbon fiber includes the product fabricated by the following steps: subjecting a carbon fiber to pre-oxidization, wherein the temperature during the pre-oxidization process is 200-300° C., and the period of pre-oxidization is 60-240 min.

Accordingly, the high module carbon fiber of the invention has a graphite sheet, and a crystalline stacking size Lc of the graphite sheet and a crystalline planar size La of the graphite sheet are defined by the following equations: 19 Å<Lc<70 Å, 35 Å<La<60 Å, and (Lc-19)≥2.5(La-40). The high module carbon fiber of the invention has a tensile strength of between 2.0-6.5 GPa and a module of between 200-650 GPa.

Further, in another embodiment of the invention, a method for fabricating the aforementioned high module carbon fiber is provided, including the following step: subjecting a pre-oxidized carbon fiber with a microwave assisted graphitization process, wherein the pre-oxidized carbon fiber is heated to a graphitization temperature of 1000-3000° C. for 1-30 min. In the microwave assisted graphitization process, a microwave absorption material can be further employed to enhance the electric field strength and produce a preheating. The microwave assisted graphitization process was conducted by microwave inducing high electric field, the microwave has a frequency of 300-30,000 MHz, and the power density of the microwave is between 0.1-300 kW/m$^2$.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The invention provides a high module carbon fiber, such as high module polyacrylonitrile (PAN) carbon fiber. The high module carbon fiber of the invention is fabricated by a microwave assisted graphitization process for rapid carbonization or graphitization at high temperature. The graphite sheet of the high module carbon fiber has a higher crystalline stacking size Lc and a lower crystalline planar size La in comparison with conventional carbon fiber. Therefore, the high module carbon fiber has a tensile strength of between 2.0-6.5 GPa and a module of between 200-650 GPa.

Figure 1B:
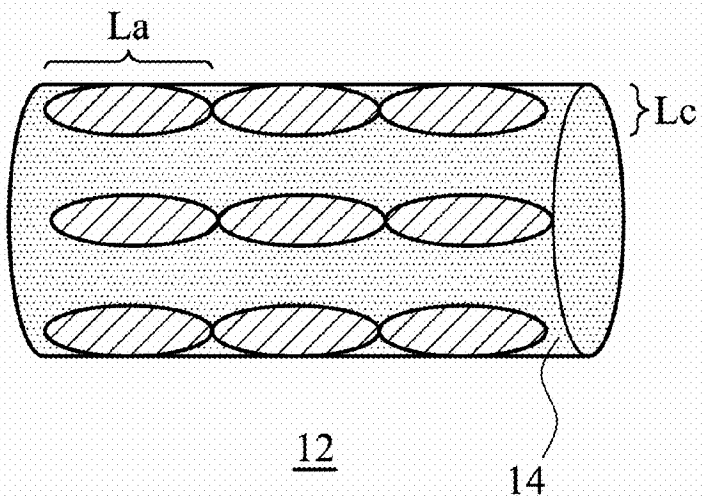
FIGS. 1*a* and 1*b* are respective schematic views showing the crystalline structure of the graphite sheet of the high module carbon fiber of the invention and the conventional carbon fiber.
Figure 1A:
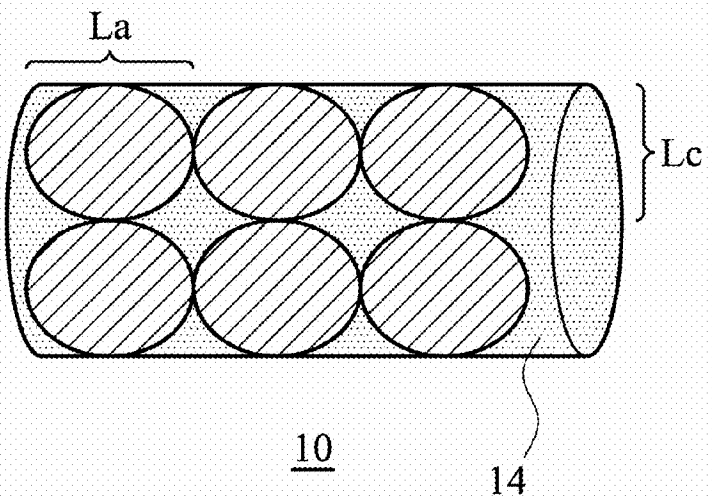

Referring to FIGS. 1*a* and 1*b*, the crystalline structure of the graphite sheet of the high module carbon fiber 10 of the invention is different from that of conventional carbon fiber. During graphitization, the growth of the crystalline planar size La of the graphite sheet 14 is inhibited (unchanging or relatively low change with respect to the growth of the crystalline stacking size Lc) and the growth of the crystalline stacking size Lc is greatly enhanced (relatively high change to the growth of the crystalline planar size La). Namely, the Lc/La ratio is increased, and the crystalline stacking size Lc and the crystalline planar size La meet a specific optimization criterion.

The method for fabricating the high module carbon fiber includes the following steps: subjecting a high strength carbon pre-fiber to pre-oxidization to obtain a high strength pre-oxidized carbon fiber, and subjecting the high strength pre-oxidized carbon fiber with a microwave assisted graphitization process to obtain the high module carbon fiber of the invention.

In comparison with conventional pre-oxidization, one key aspect of the invention is to control the temperature and period of the pre-oxidization process. The temperature of the pre-oxidization in the invention is of 200-300° C., and the period of the pre-oxidization in the invention is 60-240 min (such as 60-100 min, 100-140 min, 140-180 min, 180-240 min, or 100-240 min).

Further, the microwave assisted graphitization process of the invention has a high heating rate. During the microwave assisted graphitization process, the process temperature can reach the required graphitization temperature (1000-3000° C.) within 30 min (such as 1-10 min, 1-20 min, or 1-30 min). Therefore, the microwave assisted graphitization process has a heating rate of 0.5-200° C./s (such as 0.5-10° C./s, 0.5-50° C./s, or 0.5-100° C./s). It should be noted that the microwave assisted graphitization process of the invention employs a high frequency electric field to generate microwave energy for non-contact induction heating, wherein the microwave has a frequency of 300-30,000 MHz, and the power density of microwave is of 0.1-300 kW/$m^2$.

Figure 2:
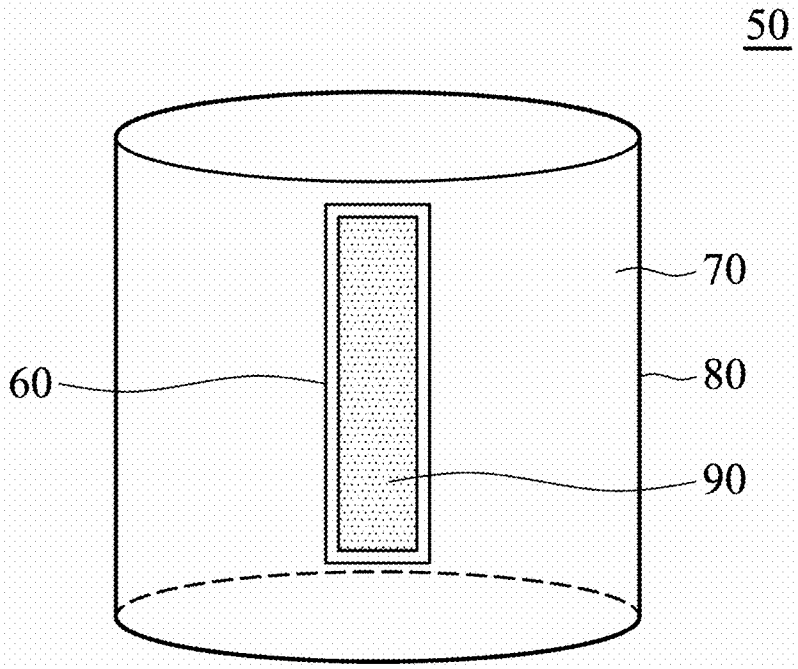
FIG. 2 is a schematic view showing the device used in the microwave assisted graphitization process according to an embodiment of the invention.

Further, FIG. 2 shows a microwave assisted graphitization device 50 having a chamber 80 used in an embodiment of the invention. An inert gas 70 is filled with the chamber 80 of the microwave assisted graphitization device 50, and a microwave absorption material 60 can be further disposed in the chamber for packaging a high tensile strength pre-oxidized carbon fiber 90. The microwave absorption material 60 can include carbide, nitride, graphite, dielectric ceramic, magnetic compounds (such as Fe-containing, Co-containing, or Ni-containing compound) and ionic compounds (such as inorganic acid salts or organic acid salts). When achieving the graphitization temperature, the conductivity, strength and module of the obtained carbon fiber is increased. Simultaneously, the microwave absorption material can collect microwave field energy for the fiber, promoting coupling between the fiber and microwave and accelerating the self-heating of the fiber.

Therefore, the heating rate and carbon fiber graphitizing rate of the microwave assisted graphitization process (employing the microwave absorption material) used in the invention is higher than those of conventional microwave process. In the microwave assisted graphitization process of the invention, the thermal energy is transported from the inward portion of the carbon fiber to the outward portion of the carbon fiber, thereby rapidly achieving graphitization temperature to form a graphite crystalline structure. The graphitization of the carbon fiber is performed under the inert gas atmosphere, preventing the carbon fiber from being incinerated by oxygen at high temperatures. The inert gas can include nitrogen, argon, helium gas, or combinations thereof.

During microwave graphitization, the microwave absorption material can collect energy from the microwave field and generate a uniform thermal field on the surface of the pre-oxidized carbon fiber, facilitating the transformation of the pre-oxidized carbon fiber into the graphite. The microwave absorption material serving as a high dielectric loss material can respond to the microwave energy in a short time to generate sufficient thermal energy which can be steadily focused on the carbon fiber, according to the microwave heating principle as shown in Equation (IV).

$$P=2\pi f\in''E^2 \qquad \text{Equation (IV)}$$

P: absorbed power (per unit volume); f: microwave frequency; $\in''$: dielectric loss; E: amplitude of microwave radiation.

Since the carbon has a high conduction loss and dielectric loss rate in the microwave field, the microwave would cause internal self-heating of the carbon. According to embodiment of the invention, the microwave assisted graphitization process of the invention can have a heating rate of more than 10-150° C./s. The rapid growth of the graphite promotes the graphitization of the polyacrylonitrile (PAN) carbon fiber, resulting in more rapid growth of the graphite. Due to the circulation of autocatalysis, the polyacrylonitrile (PAN) carbon fiber is heated rapidly to a graphitization temperature (1000-3000° C.), thereby accelerating reconstruction of carbon atoms to form a graphite sheet.

Figure 3B:
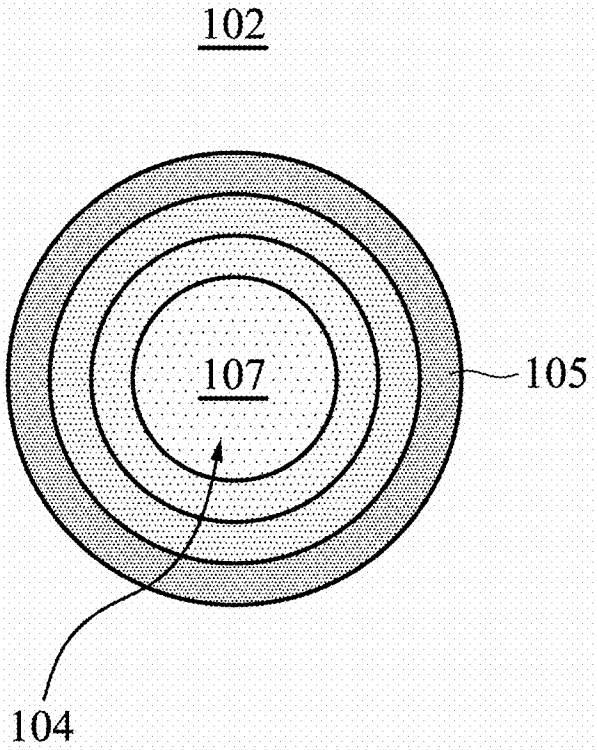
FIGS. 3*a* and 3*b* are respective schematic views showing the thermally conductive pathway of the microwave assisted graphitization process of the invention and the externally heating graphitization of prior arts.
Figure 3A:
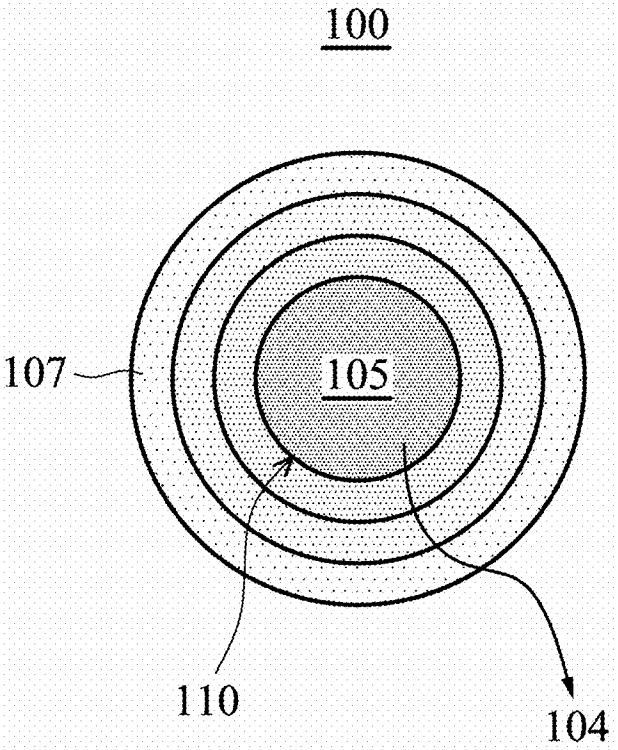

Since the microwave energy 110 causes the self-heating of the carbon fiber, the microwave assisted graphitization process of the invention is different from the externally heating graphitization (via heat conduction or radiative heat transfer) of prior art, referring to FIGS. 3*a* and 3*b*. The external heating methods at present (such as muffle furnace) have a maximum heating rate of about 10-15° C./min (0.13-0.25° C./s).

In the microwave graphitization 100 of the invention, the high temperature region 105 is located at the inward portion of the carbon fiber, and the low temperature region 107 is located at the outward portion of the carbon fiber, providing a thermally conductive pathway 104 from inside to the outside of the carbon fiber. Conversely, in the externally heated graphitization process 102, the high temperature region 105 is located at the outward portion of the carbon fiber, and the low temperature region 107 is located at the inward portion of the carbon fiber, providing a thermally conductive pathway 104 from outside to the inside of the carbon fiber. Accordingly, in the microwave assisted graphitization process of the invention, since the inward temperature of the carbon fiber is higher than the outward temperature of the carbon fiber, the carbon atoms of the crystalline structure are apt to be stacked to increase the thickness of the crystalline structure of graphite sheet during graphitization, thereby enhancing the crystalline stacking size Lc.

Meanwhile, the microwave can also reduce the energy barrier for activating molecular motions, accelerating reconfiguration and rearrangement of carbon atoms to rapidly form the graphite sheet. The crystalline stacking size Lc of the graphite sheet of the invention has a greatly increased crystalline stacking size Lc, higher graphitization efficiency, and lower cost, in comparison with the conventional graphitization process.

The high module carbon fiber fabricated by the aforementioned microwave assisted graphitization process of the invention has a higher crystalline stacking size Lc and a higher Lc/La ratio. The above characteristics are achieved by means of a threshold heating rate (>0.5° C./s) which cannot be realized by any conventional external heating process, laser heating, or microwave heating.

The raw material for fabricating high module carbon fiber of the invention is not limited to polyacrylonitrile carbon fiber and includes any suitable materials used in conventional graphitization. In general, the pre-oxidized carbon fiber can be prepared by pre-oxidizing the following fibers: polyacrylonitrile fiber, pitch fiber, novolak fiber or a combinations thereof.

The following examples are intended to illustrate the invention more fully without limiting the scope, since numerous modifications and variations will be apparent to those skilled in this art.

Example 1

Figure 4:
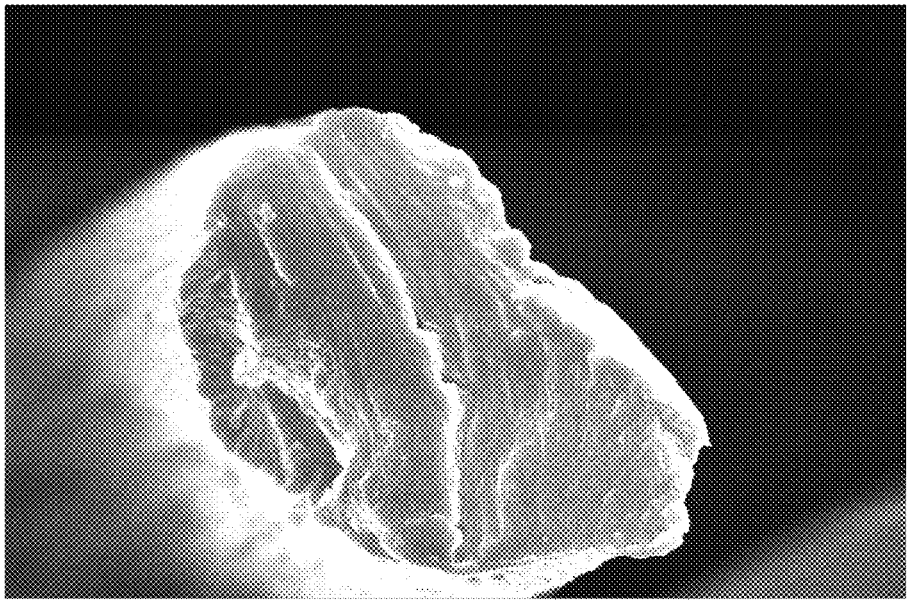
FIG. 4 is a SEM (scanning electron microscope) photograph of a high tensile strength polyacrylonitrile (PAN) pre-oxidized carbon fiber used in Example 1.

First, pre-oxidized carbon fibers (high tensile strength polyacrylonitrile (6000 filaments, and fiber diameter of 10-20 μm), sold and manufactured by Courtaulds) were provided, and FIG. 4 shows a SEM (scanning electron microscope) photograph of the pre-oxidized carbon fiber. Next, the pre-oxidized carbon fiber packaged with the microwave absorption material (carborundum or graphite composition) was disposed in a reactor with a high frequency electric field, wherein a microwave with a frequency of 2.45 GHz was used. Next, the pre-oxidized carbon fiber packaged with the microwave absorption material was subjected to the microwave assisted graphitization process under argon for 10 min with a respective microwave power of 8, 9, 10, and 11 KW, obtaining the high module polyacrylonitrile (PAN) carbon fibers (A)-

Figure 5:
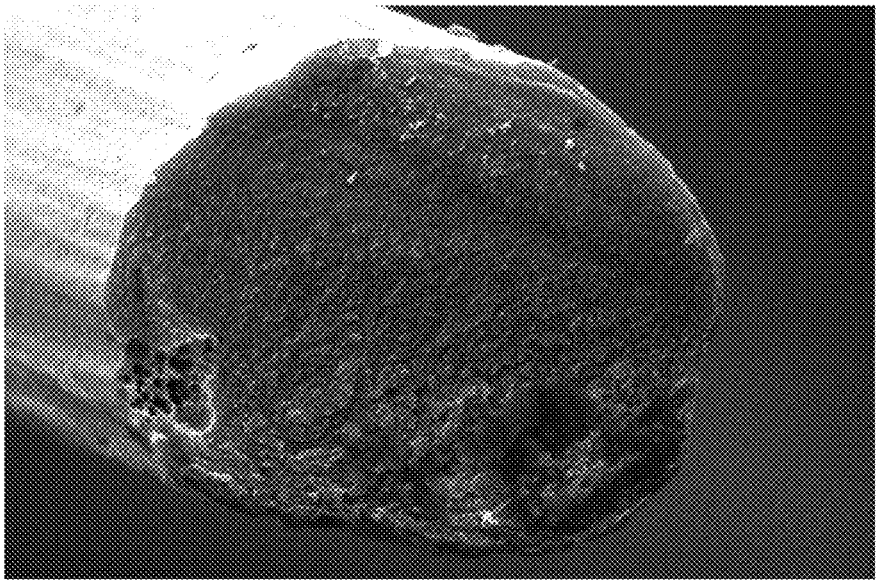
FIG. 5 is a SEM (scanning electron microscope) photograph of a high module carbon fiber prepared by Example 1.

(D). FIG. 5 shows a SEM (scanning electron microscope) photograph of a high module polyacrylonitrile (PAN) carbon fiber (A) of Example 1.

Next, the crystalline stacking size Lc, the crystalline planar size La, and the mechanical properties (module and strength) of the module polyacrylonitrile (PAN) carbon fibers (A)-(D) were measured and further compared with those properties of commercial high tensile strength carbon fibers (Toray T series) and commercial high tensile strength and high module carbon fibers (Toray MJ series). The results are shown in Table 2. The crystalline stacking size Lc and the crystalline planar size La were determined by XRD and Raman spectroscopy as above.

TABLE 2

| | microwave power (KW) | Lc (Å) | La (Å) | Lc/La | strength (GPa) | module (GPa) |
|---|---|---|---|---|---|---|
| carbon fiber of the invention | | | | | | |
| High module polyacrylonitrile carbon fiber (A) | 8 | 21.1 | 35.2 | 0.6 | 3.3 | 347 |
| High module polyacrylonitrile carbon fiber (B) | 9 | 25.8 | 39.7 | 0.65 | 3.47 | 414 |
| High module polyacrylonitrile carbon fiber (C) | 10 | 27.9 | 40.2 | 0.69 | 3.98 | 460 |
| High module polyacrylonitrile carbon fiber (D) | 11 | 30.8 | 42 | 0.73 | 4.1 | 520 |
| Commercial high tensile strength carbon fiber | | | | | | |
| Courtaulds | | 18.1 | 43.6 | 0.42 | 2.9 | 210 |
| Toray-T300 | | 18.3 | 40.1 | 0.46 | 3.53 | 230 |
| Toray-T700 | | 20.8 | 41.3 | 0.5 | 4.9 | 230 |
| Toray-T800 | | 21.4 | 43.1 | 0.5 | 5.5 | 294 |
| Toray-T1000 | | 21.9 | 45 | 0.49 | 6.3 | 294 |
| Commercial high tensile strength and high module carbon fiber | | | | | | |
| Toray-M40J | | 36.1 | 66.7 | 0.54 | 4.41 | 377 |
| Toray-M55J | | 59.6 | 80.5 | 0.74 | 4.02 | 540 |
| Toray-M60J | | 68.6 | 92.7 | 0.74 | 3.92 | 588 |

As disclosed above, the high tensile strength PAN carbon fiber, which is more available commercially than the high tensile strength and high module carbon fiber, has a crystalline stacking size Lc of 18.1-21.9 Å, a crystalline planar size La of 40.1-45 Å, a Lc/La ratio of 0.42~0.50, a tensile strength of 2.9~6.3 GPa, and a module of 210-294 GPa. As shown in Table 2, the high module carbon fiber fabricated by the microwave assisted graphitization process of the invention, which has different graphite sheet structure from conventional high tensile strength carbon fibers, has a crystalline stacking size Lc of 21.1-30.8 Å, a crystalline planar size La of 37.8-42 Å, and a Lc/La ratio of 0.56-0.73. Particularly, the crystalline stacking size Lc and the Lc/La ratio of high module carbon fiber of the invention are larger than those of the conventional high tensile strength carbon fiber. Meanwhile, the high module carbon fiber fabricated by the microwave assisted graphitization process of the invention has an improved tensile strength of 3.3-4.1 GPa and an improved module of 347-520 GPa, even in comparison with commercial high tensile strength and high module carbon fibers.

Figure 6:
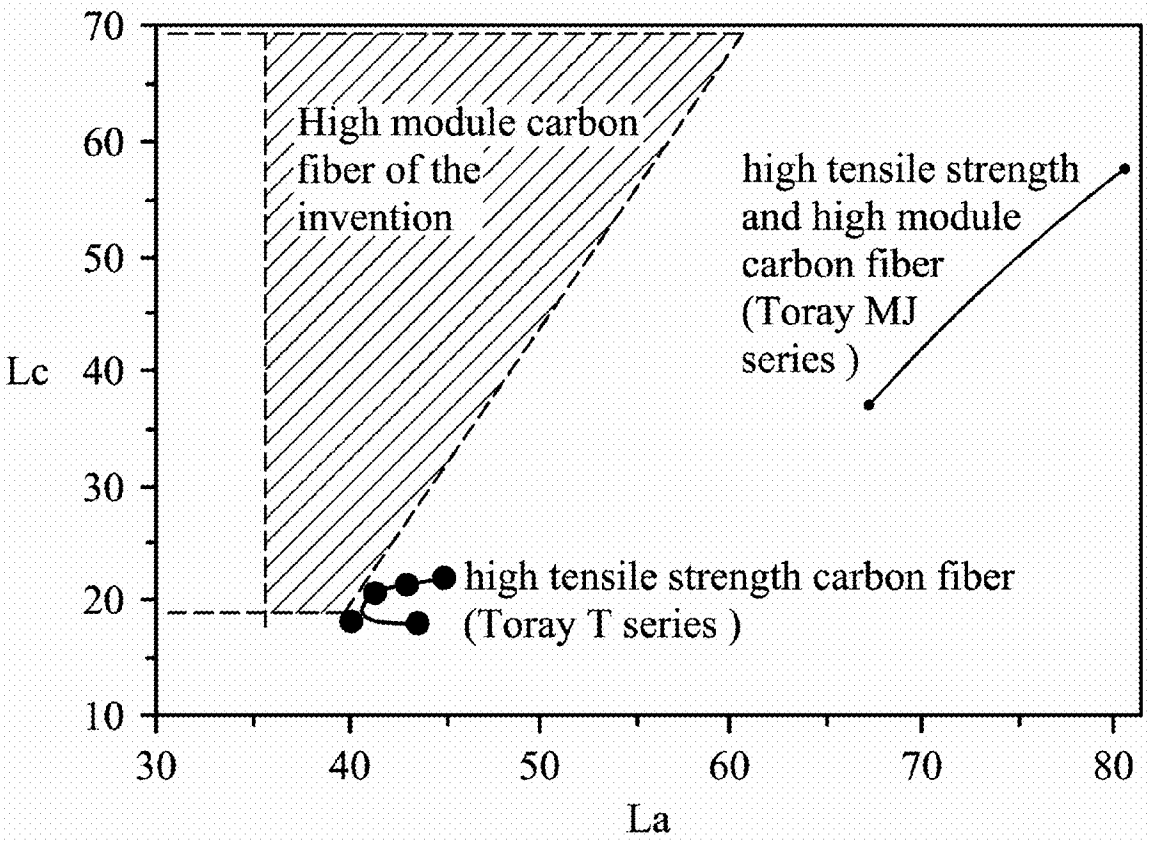
FIG. 6 shows a graph plotting Lc against La of the high module carbon fiber of the invention, commercial high tensile strength carbon fibers (Tory T series), and high tensile strength and high module carbon fiber (Tory MJ series).

FIG. 6 shows a graph plotting Lc against La of the high module carbon fiber of the invention, commercial high tensile strength carbon fibers (Tory T series), and high tensile strength and high module carbon fiber (Tory MJ series). As shown in FIG. 6, the carbon fibers of the invention have a structural range located on the top left portion of the drawing, the conventional high tensile strength has a structural range located on the middle bottom portion of the drawing, and the conventional high tensile strength and high module has a structural range located on the right portion of the drawing. The portions can be easily and clearly discriminated or distinguished from each other. The crystalline stacking size Lc and the crystalline planar size La of the high module carbon fiber of the invention can be defined by the following equations: 19 Å<Lc<70 Å, 35 Å<La<60 Å, and (Lc-19)≥2.5(La-40).

Accordingly, since the high module carbon fiber of the invention is fabricated by the microwave assisted graphitization process of the invention, the high module carbon fiber has an improved module which is higher than the high tensile strength PAN carbon fiber now serving as raw material. Due to the enhanced graphitized rate of the microwave assisted graphitization process, a high tensile strength and high module carbon fiber can be fabricated from a normal high tensile strength PAN carbon fiber. Therefore, the manufacturing cost of high module carbon fiber can be reduced by the microwave assisted graphitization process, and the applications of high module carbon fiber have increased.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A high modulus graphitized carbon fiber, comprising the product fabricated by the following steps:

subjecting a pre-oxidized carbon fiber with a microwave assisted graphitization process, wherein the pre-oxidized carbon fiber is heated to a graphitization temperature of 1000-3000° C. for 1-30 min, wherein the high modulus graphitized carbon fiber has a graphite sheet, and a crystalline stacking size Lc of the graphite sheet and a crystalline planar size La of the graphite sheet are defined by the following equations: 19 Å<Lc<70 Å, 35 Å<La<60 Å, and (Lc-19)≥2.5(La-40), and wherein the high modulus graphitized carbon fiber has a tensile strength of between 2.0-6.5 GPa and a modulus of between 200-650 GPa.

2. The high modulus graphitized carbon fiber as claimed in claim 1, wherein the pre-oxidized carbon fiber comprises the product fabricated by the following steps:

subjecting a carbon fiber to pre-oxidization, wherein the temperature of the pre-oxidization is between 200-300° C., and the period of the pre-oxidization is between 60-240 min.

3. The high modulus graphitized carbon fiber as claimed in claim 2, wherein the carbon fiber comprises polyvinyl alcohol, polyvinylidene chloride, asphalt, polyacrylonitrile, or combinations thereof.

4. The high modulus graphitized carbon fiber as claimed in claim 1, wherein a microwave absorption material is employed in the microwave assisted graphitization process for enhancing electric field strength and processing preheating.

5. The high modulus graphitized carbon fiber as claimed in claim 4, wherein the microwave absorption material comprises carbide, nitride, graphite, magnetic compound, dielectric ceramic, ionic compound, or combinations thereof.

6. The high modulus graphitized carbon fiber as claimed in claim 1, wherein the microwave assisted graphitization process is performed under an inert gas atmosphere.

7. The high modulus graphitized carbon fiber as claimed in claim 6, wherein the inert gas atmosphere comprises nitrogen, argon, helium gas, or combinations thereof.

8. The high modulus graphitized carbon fiber as claimed in claim 1, wherein the microwave assisted graphitization process has a heating rate of 0.5-200° C./s.

9. The high modulus graphitized carbon fiber as claimed in claim 1, wherein the microwave assisted graphitization process employs a high frequency electric field to generate a microwave, wherein the microwave has a frequency of 300-30,000 MHz, and the power density of the microwave is between 0.1-300 kW/m2.

10. A method for fabricating a high modulus graphitized carbon fiber, comprising:

subjecting a pre-oxidized carbon fiber with a microwave assisted graphitization process, wherein the pre-oxidized carbon fiber is heated to a graphitization temperature of 1000-3000° C. for 1-30 min, obtaining the high modulus graphitized carbon fiber as claimed in claim 1.

11. The method for fabricating high modulus graphitized carbon fiber as claimed in claim 10, wherein the pre-oxidized carbon fiber comprises the product fabricated by the following steps:

subjecting a carbon fiber to pre-oxidization, wherein the temperature of the pre-oxidization process is between 200-300° C., and the period of the pre-oxidization is of 60-240 min.

12. The method for fabricating high modulus graphitized carbon fiber as claimed in claim 11, wherein the carbon fiber comprises polyvinyl alcohol, polyvinylidene chloride, asphalt, polyacrylonitrile, or combinations thereof.

13. The method for fabricating high modulus graphitized carbon fiber as claimed in claim 10, wherein a microwave absorption material is employed in the microwave assisted graphitization process for enhancing electric field strength and processing preheating.

14. The method for fabricating high modulus graphitized carbon fiber as claimed in claim 13, wherein the microwave absorption material comprises: carbide, nitride, graphite, magnetic compound, dielectric ceramic, ionic compound, or combinations thereof.

15. The method for fabricating high modulus graphitized carbon fiber as claimed in claim 10, wherein the microwave assisted graphitization process is performed under an inert gas atmosphere.

16. The method for fabricating high modulus graphitized carbon fiber as claimed in claim 15, wherein the inert gas atmosphere comprises nitrogen, argon, helium gas, or combinations thereof.

17. The method for fabricating high modulus graphitized carbon fiber as claimed in claim 10, wherein the microwave assisted graphitization process has a heating rate of 0.5-200° C./s.

18. The method for fabricating high modulus graphitized carbon fiber as claimed in claim 10, wherein the microwave assisted graphitization process employs a high frequency electric field to generate a microwave, wherein the microwave has a frequency of 300-30,000 MHz, and the power density of microwave is of 0.1-300 kW/m2.

* * * * *